US011454050B2

(12) United States Patent
Nave

(10) Patent No.: US 11,454,050 B2
(45) Date of Patent: Sep. 27, 2022

(54) ELECTRONIC HIDDEN SHACKLE PADLOCK WITH KEY OVERRIDE

(71) Applicant: Master Lock Company LLC, Oak Creek, WI (US)

(72) Inventor: Zachary T. Nave, Oak Creek, WI (US)

(73) Assignee: MASTER LOCK COMPANY LLC, Oak Creek, WI (US)

( * ) Notice: Subject to any disclaimer, the term of this patent is extended or adjusted under 35 U.S.C. 154(b) by 333 days.

(21) Appl. No.: 16/766,074

(22) PCT Filed: Nov. 20, 2018

(86) PCT No.: PCT/US2018/062138
§ 371 (c)(1),
(2) Date: May 21, 2020

(87) PCT Pub. No.: WO2019/104102
PCT Pub. Date: May 31, 2019

(65) Prior Publication Data

US 2020/0332561 A1 Oct. 22, 2020

Related U.S. Application Data

(60) Provisional application No. 62/590,091, filed on Nov. 22, 2017.

(51) Int. Cl.
*E05B 47/06* (2006.01)
*E05B 47/00* (2006.01)
(Continued)

(52) U.S. Cl.
CPC ..... *E05B 47/0603* (2013.01); *E05B 47/0012* (2013.01); *E05B 47/0611* (2013.01);
(Continued)

(58) Field of Classification Search
CPC ... Y10T 70/439; Y10T 70/441; Y10T 70/443; Y10T 70/493; Y10T 70/496;
(Continued)

(56) References Cited

U.S. PATENT DOCUMENTS 4,901,545 A 2/1990 Bacon et al.
4,967,577 A 11/1990 Gartner et al.
(Continued)

FOREIGN PATENT DOCUMENTS

CN 102278011 A 12/2011
CN 204511067 U 7/2015
(Continued)

OTHER PUBLICATIONS

International Search Report and Written Opinion, PCT/US2018/062138, Master Lock Company LLC (dated Apr. 23, 2019).
(Continued)

*Primary Examiner* — Lloyd A Gall
(74) *Attorney, Agent, or Firm* — Foley & Lardner LLP

(57) ABSTRACT

Systems and apparatuses include a lock including a shackle movable between an unlocked state and a locked state, an electronically actuated blocker selectively engaged with the shackle to inhibit movement of the shackle from the locked state to the unlocked state, the blocker movable between a key override disabled position, a key override enabled position, and an electronic unlock position, and a key cylinder structured to move the shackle to the unlocked state when the blocker is in the key override enabled position.

20 Claims, 9 Drawing Sheets

(51) Int. Cl.
*E05B 67/24* (2006.01)
*E05B 67/38* (2006.01)
*G07C 9/00* (2020.01)

(52) U.S. Cl.
CPC ..... *E05B 67/24* (2013.01); *E05B 67/383* (2013.01); *G07C 9/00182* (2013.01); *G07C 9/00658* (2013.01); *G07C 2009/0019* (2013.01)

(58) Field of Classification Search
CPC ..... Y10T 70/498; Y10T 70/7102; Y10T 70/7107; Y10T 70/7079; Y10T 70/713; Y10T 70/7136; Y10T 70/7141; Y10T 70/7147; Y10T 70/7576; Y10T 70/7582; E05B 47/0603; E05B 47/0012; E05B 47/0611; E05B 67/24; E05B 67/383; E05B 67/36; G07C 9/00182; G07C 9/00658; G07C 2009/0019
See application file for complete search history.

(56) References Cited

U.S. PATENT DOCUMENTS 5,127,244 A * 7/1992 Myers ..... E05B 67/36 70/32
5,345,794 A * 9/1994 Jenks ..... E05B 67/36 70/32
6,338,261 B1 * 1/2002 Liu ..... E05B 67/36 70/2
6,539,755 B1 4/2003 Bruwer et al.
6,761,051 B1 * 7/2004 Tsai ..... E05B 47/0012 70/279.1
2004/0011092 A1 * 1/2004 Haczynski ..... E05B 67/36 70/56
2005/0006908 A1 1/2005 Bruwer et al.
2005/0252257 A1 * 11/2005 Woods ..... E05B 67/36 70/56
2006/0260368 A1 * 11/2006 Reitchuk ..... E05B 67/36 70/33
2006/0283216 A1 * 12/2006 Marcelle ..... G07C 9/00182 70/38 A
2009/0282876 A1 * 11/2009 Zuraski ..... E05B 67/003 70/278.1
2019/0051074 A1 * 2/2019 Ufkes ..... H04W 4/80
2022/0180681 A1 * 6/2022 Ufkes ..... E05C 19/08

FOREIGN PATENT DOCUMENTS

CN 106996221 A 8/2017
WO WO-2015/065944 A1 5/2015

OTHER PUBLICATIONS

Foreign Action other than Search Report on CN 201880083250.2 dated Mar. 26, 2021, 6 pages.

* cited by examiner

ELECTRONIC HIDDEN SHACKLE PADLOCK WITH KEY OVERRIDE

CROSS-REFERENCE TO RELATED PATENT APPLICATIONS

This application is a National Stage Application of PCT/US2018/062138, filed Nov. 20, 2018, which claims the benefit of U.S. Provisional Patent Application No. 62/590,091 filed on Nov. 22, 2017, the entire contents of which are incorporated herein by reference.

BACKGROUND

The present disclosure relates generally to the field of locking devices. According to some embodiments, the disclosure relates to locking devices, such as electronic locks for lockers, that include a physical key override that allows a key to open the locking device.

Electronic locking devices operate conveniently for users. In some such devices, users may enter a code or interact with the lock in some other manner, and the lock can automatically transition from a locked to an unlocked state or from an unlocked to a locked state. Keyed locks operate with a physical key and allow the user to manually operate the locking mechanism.

SUMMARY

One exemplary embodiment relates to a lock that includes a housing, a keypad coupled to the housing and including a user interface, an actuator in communication with the keypad and movable between a first position, a second position, and a third position, a cam coupled to the actuator and movable therewith, and a blocker including a cam follower in selective engagement with the cam, a cutout, and a shoulder. The blocker is movable between an open position, a closed position, and an intermediate position. A shackle includes a recess sized to receive the blocker and is movable between an unlocked state and a locked state, and a key cylinder is coupled to and moveable with the shackle. The first position of the actuator includes the cam interacting with the blocker in the closed position, and the blocker engaging the recess of the shackle to maintain the shackle in the locked state. The second position of the actuator includes the cam interacting with the blocker in the intermediate position, the key cylinder rotating the shackle, and the recess of the shackle engaging the shoulder of the blocker and moving the blocker toward the open position. The third position of the actuator includes the cam interacting with the blocker in the closed position, the cutout positioned adjacent the shackle, and the shackle allowed to move between the locked position and the unlocked position.

Another exemplary embodiment relates to a lock that includes a shackle movable between an unlocked state and a locked state, an electronically actuated blocker selectively engaged with the shackle to inhibit movement of the shackle from the locked state to the unlocked state, the blocker movable between a key override disabled position, a key override enabled position, and an electronic unlock position, and a key cylinder structured to move the shackle to the unlocked state when the blocker is in the key override enabled position.

Another exemplary embodiment relates to a method that includes moving a cam to a key override disabled position with an electronic actuator, biasing a blocker into engagement with the cam so that the blocker is in a closed position when the cam is in the key override disabled position, inhibiting movement of a shackle from a locked position to an unlocked position when the blocker is in the closed position, moving the cam to a key override enabled position with the electronic actuator, biasing the blocker into engagement with the cam so that the blocker is in an intermediate position when the cam is in the key override enabled position, inhibiting movement of the shackle from the locked position to the unlocked position when the blocker is in the intermediate position, and rotating the shackle with a key cylinder so the blocker is moved to an open position by the movement of the shackle when the cam is in the key override enabled position thereby allowing the shackle to move to the unlocked position.

The invention is capable of other embodiments and of being carried out in various ways. Alternative exemplary embodiments relate to other features and combinations of features as may be recited herein.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary constructions in detail, it should be understood that the application is not limited to the details or methodology set forth in the description or illustrated in the figures. It should also be understood that the terminology is for the purpose of description only and should not be regarded as limiting.

Referring generally to the figures, varying systems and methods for locking a door (e.g., a door of a locker) or other component are shown and described. According to some embodiments, a lock can include an electronic keypad and a key cylinder that work together to actuate a shackle between a locked position and an unlocked position. A blocker is positioned within the lock and structured to interact with the shackle to selectively inhibit the shackle from moving from the locked position to the unlocked position. The electronic keypad is structured in communication with a battery powered electric motor that selectively rotates a cam shaped to interact with the blocker. The cam is moveable between a key override disabled position where the shackle is in the locked position and the key is unable to move the blocker from a closed position, a key override enabled position where the shackle is in the locked position and the key is able to move the blocker from an intermediate position, and an electronic unlock position where the blocker is moved to an open position and the shackle is free to move to the unlocked position. The key cylinder interacts directly with the shackle and dependent on the state of the cam and therefore the blocker, the key can be used to actuate the shackle between the locked position and the unlocked position. In operation, a user can use either the electronic key pad or the physical key to actuate the lock.

In some embodiments, the electronic keypad includes wireless connectivity and can be communicated with from a handheld or other remote device (e.g., a smart phone) to actuate the lock. In some embodiments, the cam can be arranged in the key override disabled position (i.e., thereby blocking the ability to unlock with a physical key) unless the key is in communication with the electronic key pad (e.g., a master key with RFID capability).

Figure 1:
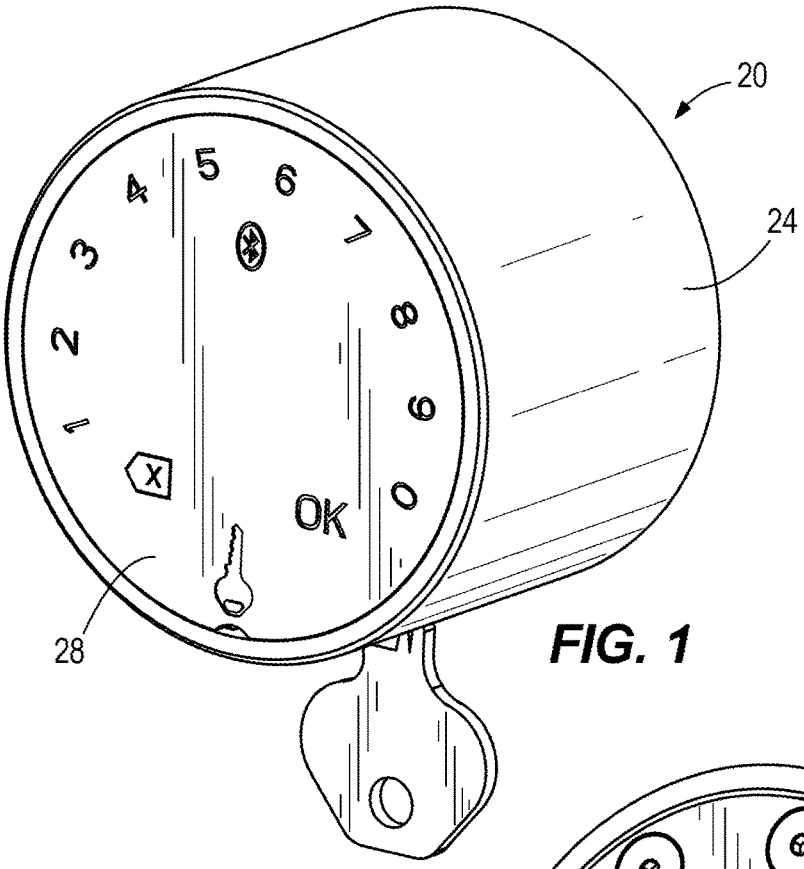
FIG. 1 is a top, right, front perspective view of a lock according to one construction.

As shown in FIG. 1, a lock 20 includes a housing 24 and an electronic faceplate or keypad 28 connected to the housing 24 to enclose the lock 20. The keypad 28 includes a touch surface that allows a user to interact with the keypad 28. In some constructions, the keypad can include physical buttons or switched buttons, or a mix of touch surfaces and physical buttons to provide user interaction.

In some constructions, the keypad 28 provides ten numeric touch sensitive buttons (e.g., 1-9 and 0), an OK or accept/submit button, a backspace or delete button, and a lock button. Additionally, the keypad 28 can include indicator devices such as audible alarms, lights, or logos. For example, a Bluetooth™ icon that illuminates when connected to a paired device can be included. The keypad 28 also includes a controller or control circuits that communicate with the touch sensitive buttons and provide outputs for operation of the lock 20.

Figure 2:
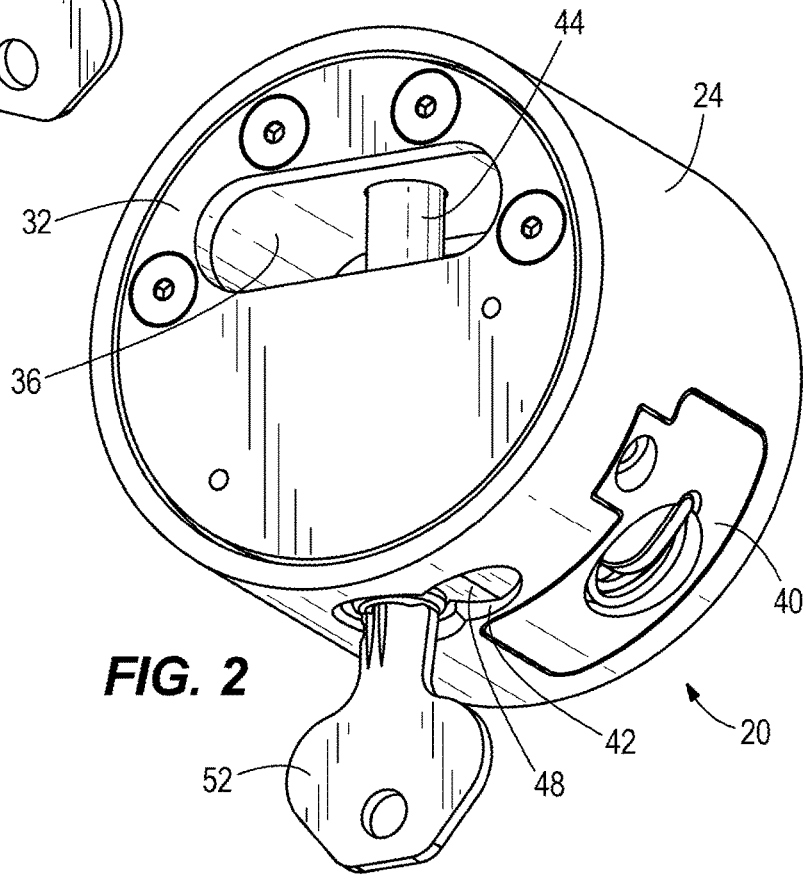
FIG. 2 is a bottom, left, back perspective view of the lock of FIG. 1.

As shown in FIG. 2, the housing 24 includes a back panel 32 that defines a locking cavity 36. A battery access 40 is formed in the housing 24 and provides access for changing the batteries of the lock 20. In some embodiments, the battery access 40 can include a data connection or port for programming or updating the lock 20. In some embodiments, the battery access 40 is arranged so that access in inhibited unless the lock is in an unlocked state. The housing 24 also defines a key cylinder opening 42 in a bottom area of the housing 24. In other embodiments, the key cylinder opening 42 is arranged in another location on the housing 24.

FIG. 2 shows the lock 20 in a locked state and a shackle 44 is visible within the locking cavity 36. The shackle 44 is connected to a key cylinder 48 that is received in the key cylinder opening 42 of the housing 24. A key 52 is received in the key cylinder 48 and selectively moveable between a locked key position (e.g., shown in FIGS. 1 and 2) and an unlocked key position (e.g., shown in FIGS. 13 and 14).

Figure 3:
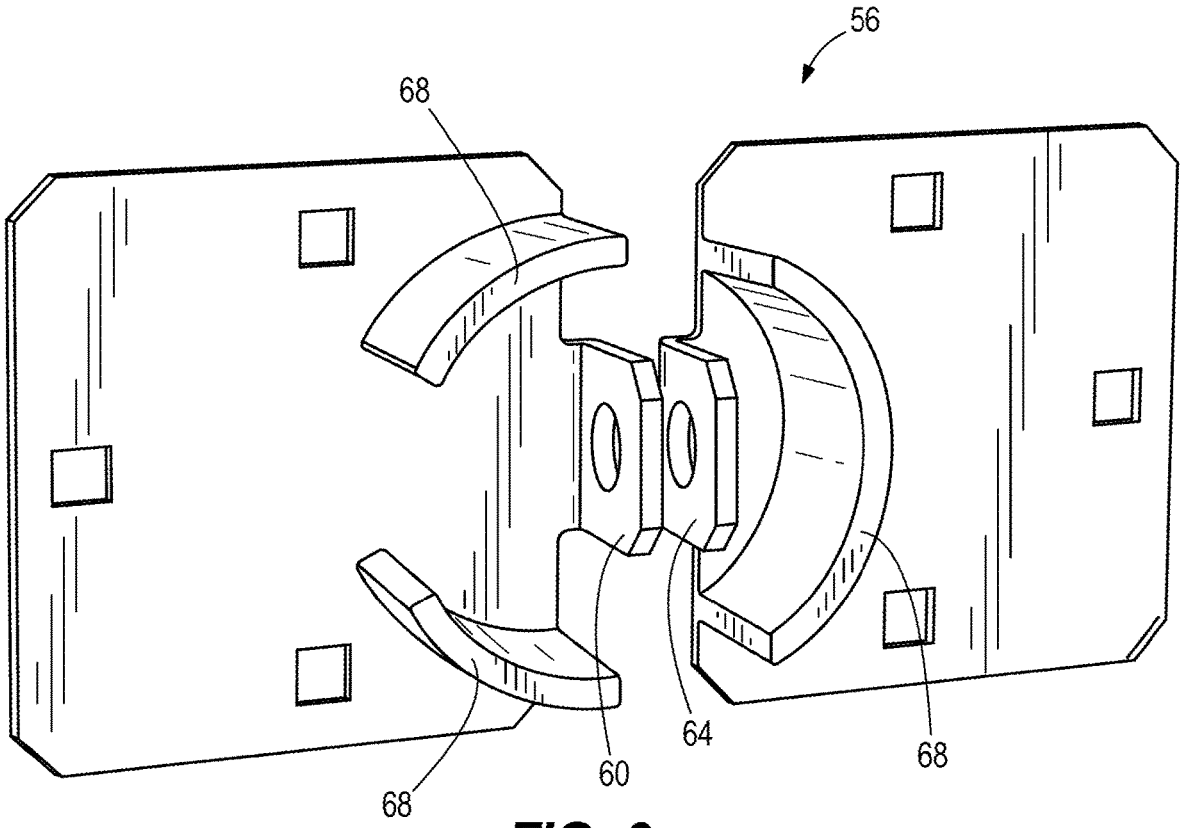
FIG. 3 is a perspective view of a hasp structured for use with the lock of FIG. 1 according to one construction.

As shown in FIG. 3, the lock 20 can be structured to engage a hasp 56 that includes a first locking projection 60 and a second locking projection 64 that are attachable to separate surfaces (e.g., a door and a jamb, mating doors, etc.). Security projections 68 are sized to receive the lock 20 and inhibit removal of the lock from the hasp 56 by prying. Other hasps are usable with the lock 20 and the particular arrangement of the hasp 56 shown in FIG. 3 is not limiting to the invention.

Figure 4:
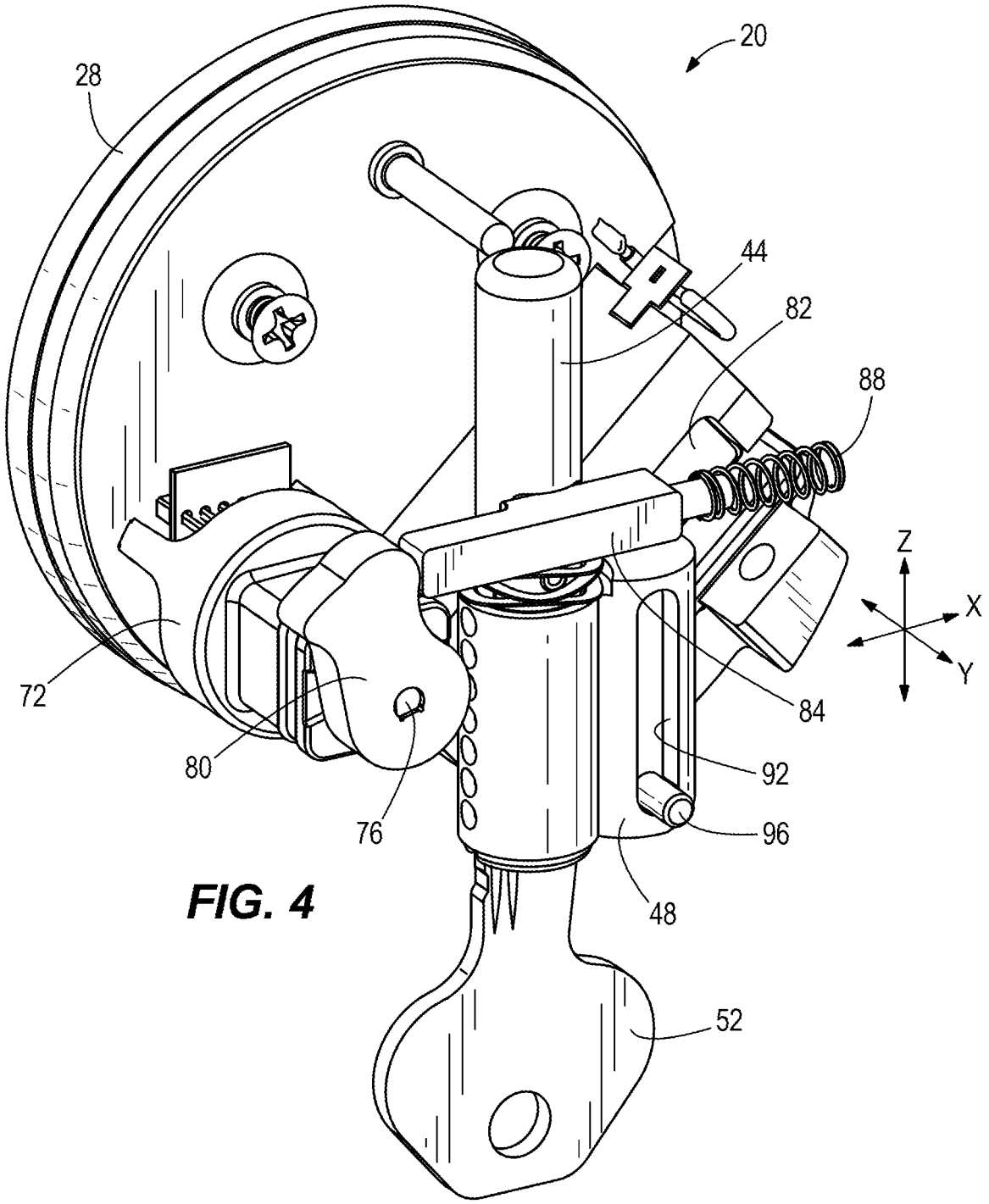
FIG. 4 is a top, right, front perspective view of the lock of FIG. 1 in an unlocked arrangement.

As shown in FIG. 4, the housing 24 is removed from the lock 20 exposing the interior components. An electric motor 72 is arranged in communication with the keypad 28 and controlled thereby. In some embodiments, the electric motor 72 is a stepper motor, a servo motor, or another motor type that is position controlled. The electric motor 72 includes an output shaft 76 engaged with a cam 80 so that the cam 80 can be moved in response to user input received from the user via the keypad 28. A battery 82 is positioned within the battery access 40 and provides power to the keypad 28 and the electric motor 72.

A blocker 84 is supported by the housing 24 for sliding movement along an X-axis between a closed position (see FIG. 4), an open position (see FIGS. 13 and 14), and an intermediate position (see FIGS. 9 and 10) that is between the closed position and the open position. The blocker 84 is biased toward the closed position by a spring 88. The blocker 84 is arranged to selectively allow or inhibit the shackle 44 from moving between the locked state (see FIG. 4) and an unlocked state (see FIG. 14).

The key cylinder 48 includes a slot 92 sized to receive a pin 96 that is supported by the housing 24. The pin 96 is held stationary by the housing 24 and the slot 92 is sized to allow sliding movement along a Z-axes between the locked state and the unlocked state.

Figure 5:
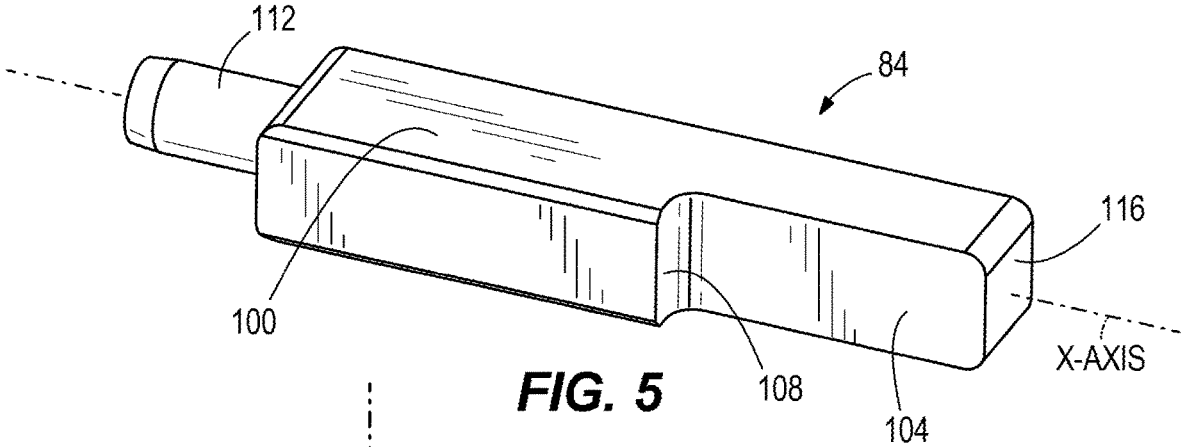
FIG. 5 is a perspective view of a blocker of the lock of FIG. 1 according to one construction.

As shown in FIG. 5, the blocker 84 includes a body 100, a cutout 104, a shoulder 108 positioned between the body 100 and the cutout 104, a post 112 sized to receive the spring 88, and a cam follower 116 structured to selectively contact the cam 80. The body 100 is sized to overlap with an outer diameter of the shackle 44 and the cutout 104 is sized to allow the outer diameter of the shackle 44 to pass by. In some embodiments, the cutout 104 defines a flat surface inset from the body 100. In some embodiments, the cutout 104 is a rounded recess formed in the body 100. In some embodiments, the shoulder 108 is substantially square and normal to the cutout 104. In some embodiments, the shoulder 108 is rounded.

Figure 6:
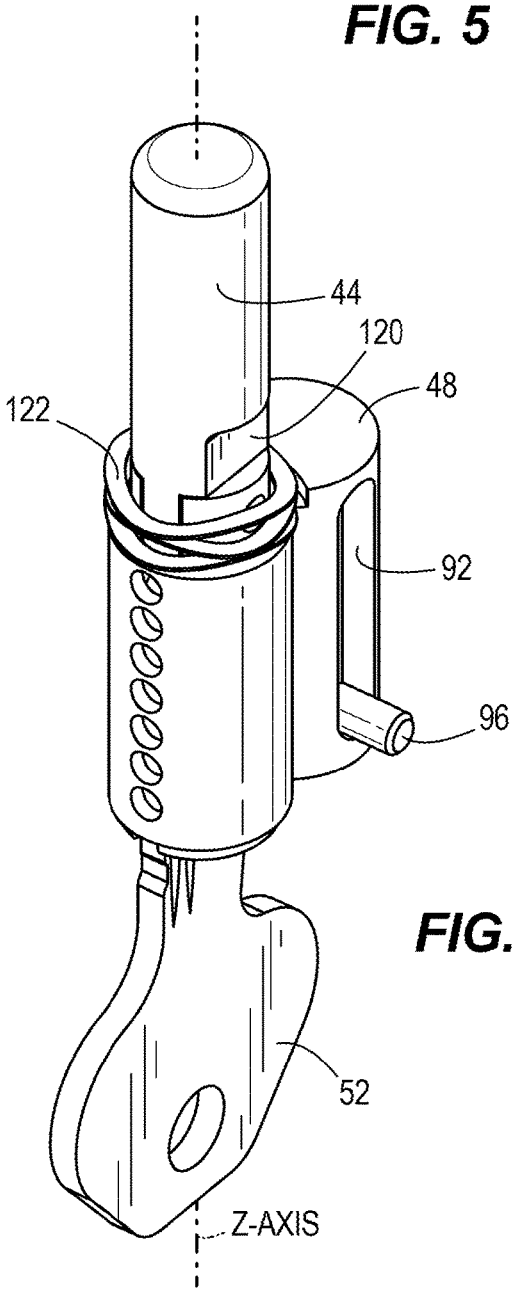
FIG. 6 is a perspective view of a shackle and key cylinder assembly of the lock of FIG. 1 according to one construction.

As shown in FIG. 6, the shackle 44 is fastened to the key cylinder 48 so that movement of the key cylinder 48 along the Z-axis results in movement of the shackle 44. Additionally, rotation of the key 52 within the key cylinder 48 results in rotation of the shackle 44 about the Z-axis. The shackle 44 includes a recess 120 that is sized to receive the body 11 of the blocker 84. In some embodiments, the recess 120 defines a flat surface or an override feature arranged to engage the shoulder 108 of the blocker 84. An unlock spring 122 surrounds the shackle 44 and seats against the key cylinder 48. The unlock spring 122 is arranged to bias the shackle 44 and key cylinder 48 toward the unlocked state when the key cylinder 48 is received within the housing 24.

Operation of the lock 20 will be described below with respect to FIGS. 7-16. In general, the lock 20 is actuated between three modes or states. A first mode includes a locked state with a key override disabled. A second mode includes a locked state with a key override enabled. A third mode includes an electronic unlock.

Figure 7:
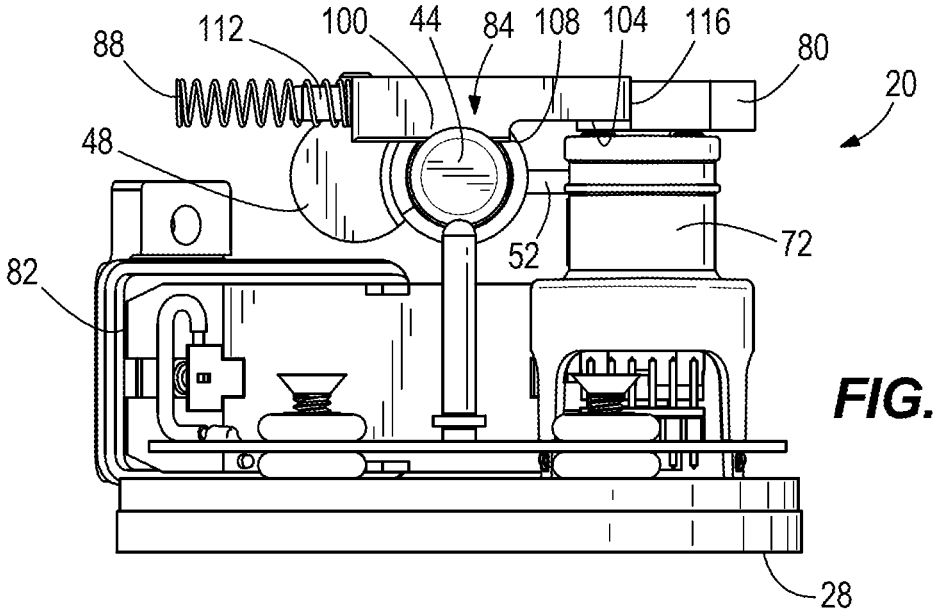
FIG. 7 is a top view of the lock of FIG. 1 with the housing removed and the lock arranged in a locked state with a key override disabled.
Figure 8:
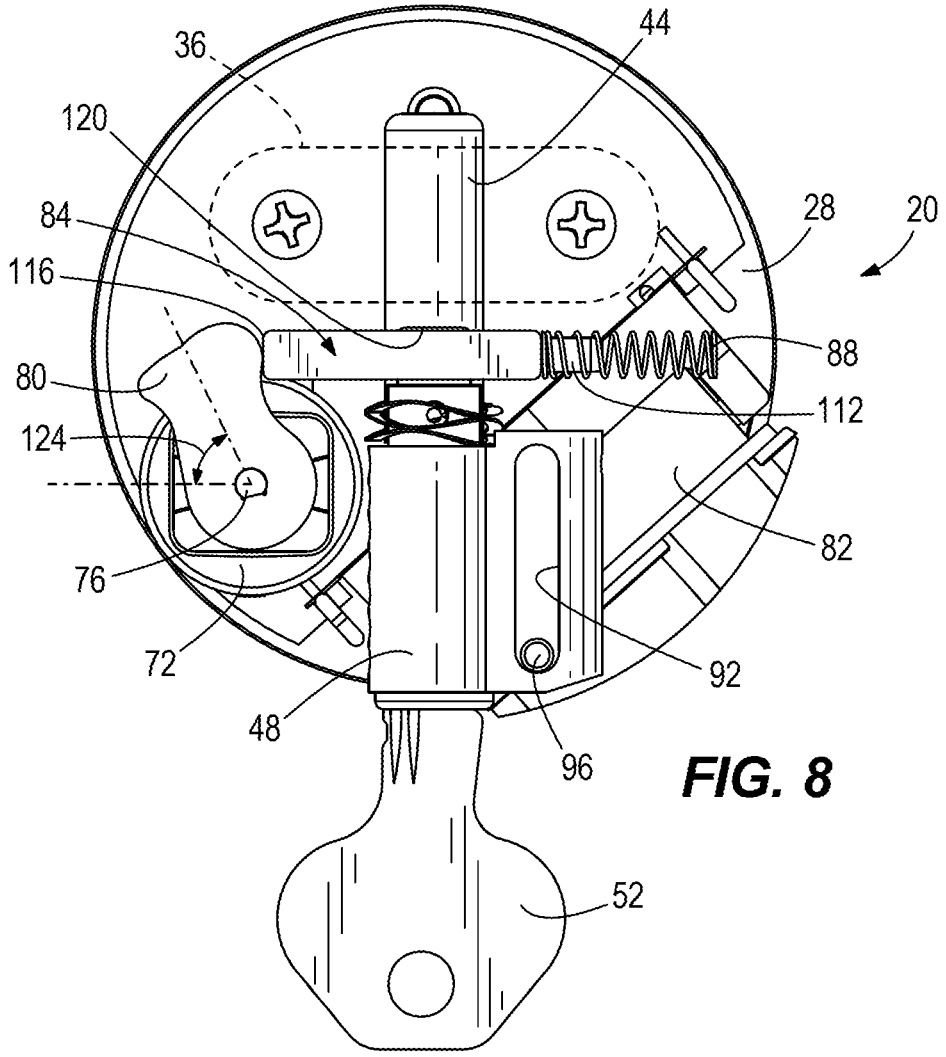
FIG. 8 is a back view of the lock of FIG. 7.

As shown in FIGS. 7 and 8, the first mode includes the shackle 44 in a locked position with the body 100 of the blocker 84 positioned in a closed position and engaged within the recess 120 of the shackle 44. The motor 72 rotates the cam 80 to a key override disabled position where a disable angle 124 is defined between a centerline of the cam 80 and horizontal. In some embodiments, the disable angle 124 is about fifty-five degrees (55°). In some embodiments, the disable angle 124 is between about forty-five degrees (45°) and about sixty-five degrees (65°). The cam follower 116 of the blocker 84 is biased into engagement with a cam surface of the cam 80 by the spring 88 so that the body 100 of the blocker 84 substantially fully fills the recess 120 of the shackle 44. With the body 100 engaged with the recess 120, the shackle 44 is inhibited from moving to an open position (i.e., vertically downward in FIG. 8 along the Z-axis).

In the first mode, the key 52 cannot be used to actuate the lock 20 to the open state. Any attempt to turn the key 52 results in the recess 120 of the shackle 44 abutting or impeded by the body 100 of the blocker 84. In the first mode, the user may inhibit other users in possession of a key 52 from opening the lock 20.

Figure 9:
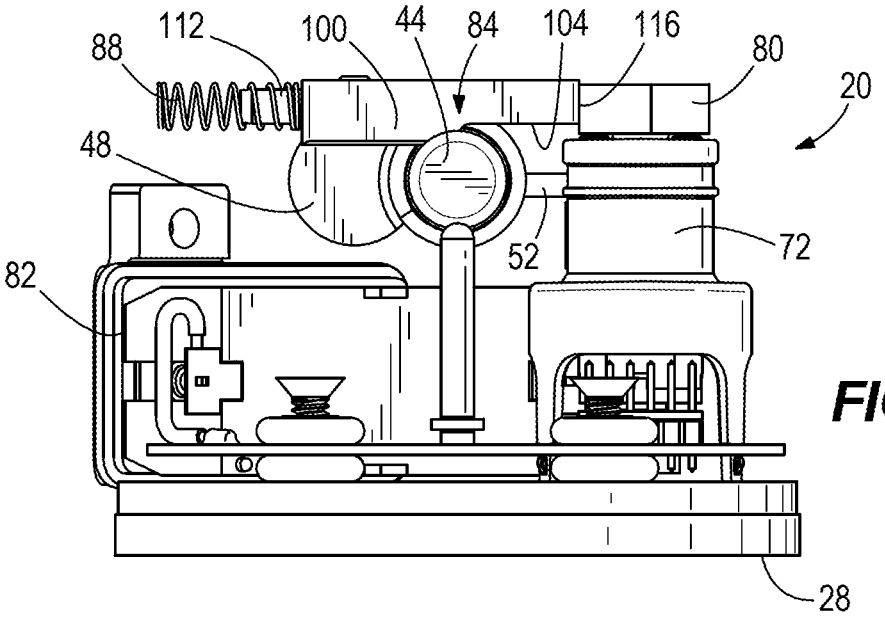
FIG. 9 is a top view of the lock of FIG. 1 with the housing removed and the lock arranged in the locked state with a key override enabled.
Figure 10:
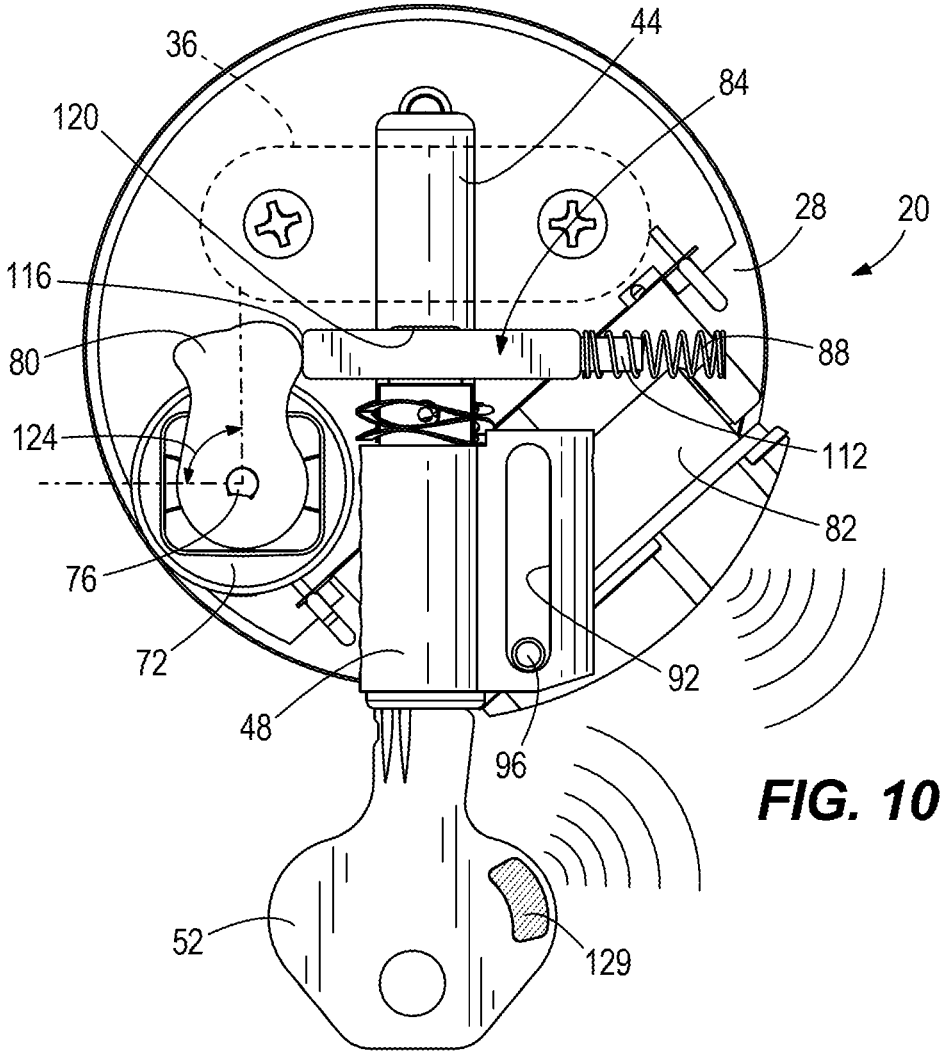
FIG. 10 is a back view of the lock of FIG. 9.

As shown in FIGS. 9 and 10, the second mode includes the shackle 44 arranged in the locked position and the blocker 84 arranged in an intermediate position. The motor 72 moves the cam 80 into a key override enabled position where an enable angle 128 is about ninety degrees (90°). In some embodiments, the enable angle 128 is between about seventy-five degrees (75°) and about one-hundred-five degrees (105°). The cam follower 116 of the blocker 84 is biased into engagement with the cam surface of the cam 80 by the spring 88 so that the blocker 84 is in the intermediate position and the shoulder 108 is engaged within the recess 120 of the shackle 44. With the shoulder 108 engaged with the recess 120, the shackle 44 is inhibited from moving to an open position (i.e., vertically downward in FIG. 10 along the Z-axis).

In the second mode, the shoulder 108 of the blocker 84 is engaged with the recess 120 of the shackle 44 so that rotation of the key 52 within the key cylinder 48 results in the shoulder 108 exerting a translational force on the blocker 84.

In some embodiments, the lock 20 includes a master key setting that only allows a particular key 52 to open the lock 20. For example, the key 52 may include an RFID transponder 129 that is structured to communicate with an RFID reader and antenna included in the keypad 28. When the RFID transponder 129 is out of range of the keypad 28, the lock is arranged in the first mode with key override disabled and no keys can open the lock 20. When the RFID transponder 129 is in range of the keypad 28, the lock 20 is actuated to the second mode and key override is enabled. The master key 52 can then be used to open the lock 20. In some embodiments, other communication architecture is used. For example, Bluetooth™ could be used to actuate the lock 20 into the second mode. In some embodiments, a smart phone or another smart device may be used to actuate the lock into the second mode.

Figure 11:
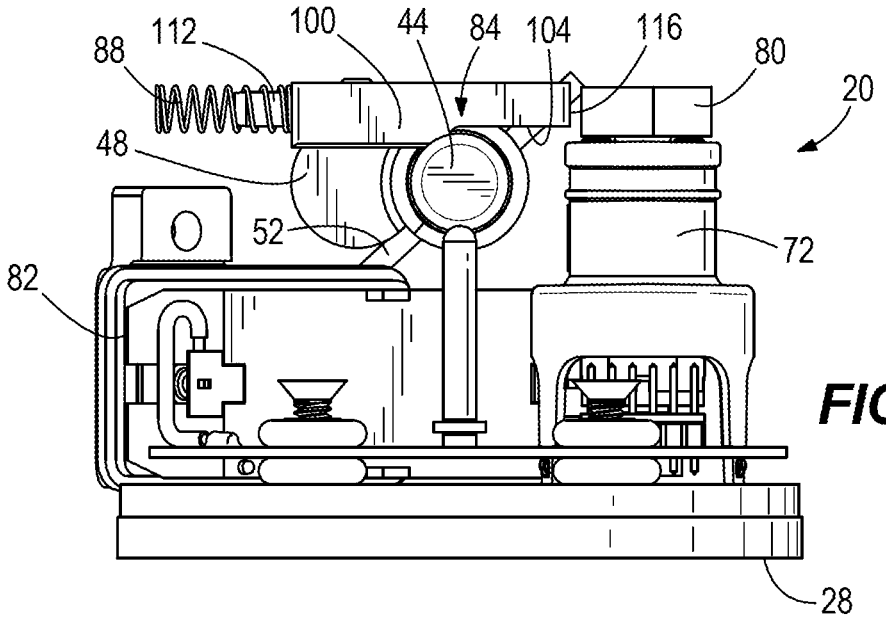
FIG. 11 is a top view of the lock of FIG. 1 with the housing removed and the lock arranged in a locked state with a key override disabled and a key actuating the key cylinder.
Figure 12:
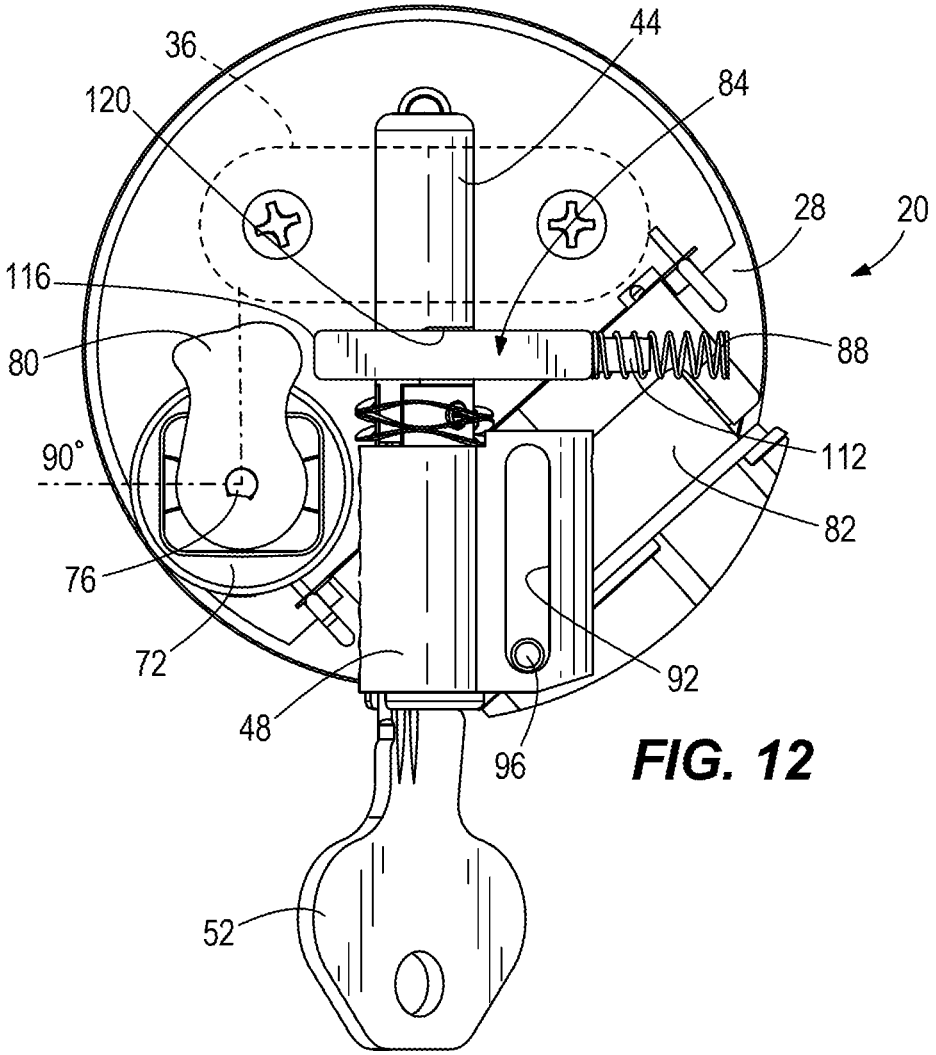
FIG. 12 is a back view of the lock of FIG. 11.

As shown in FIGS. 11 and 12, as the user continues to turn the key 52, the blocker 84 is pushed by the recess 120 in an open direction (e.g., toward the right along the X-axis in FIG. 12). The cam 80 remains in the key override enabled position so that a separation between the cam surface and the cam follower 116 of the blocker 84 is created. The key 52 is turned and the blocker 84 is moved against the bias of the spring 88.

Figure 13:
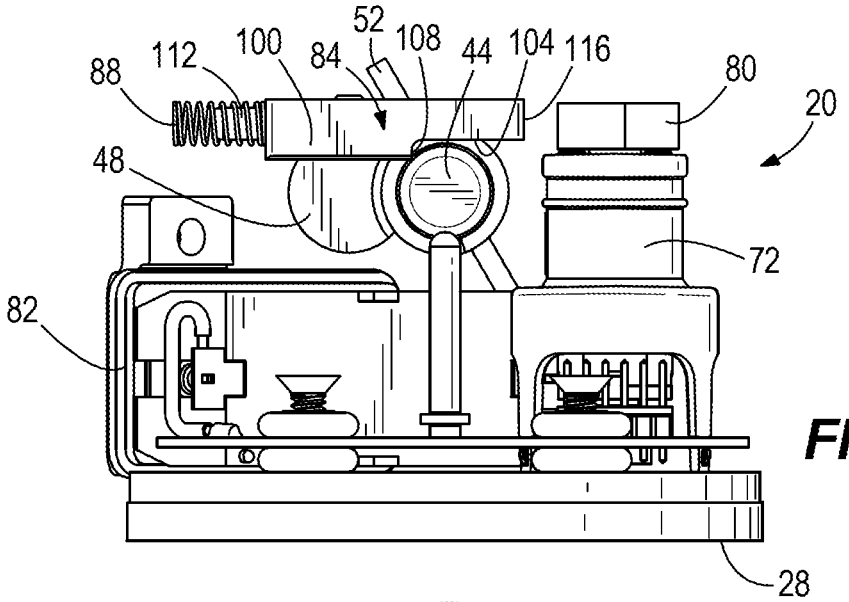
FIG. 13 is a top view of the lock of FIG. 1 with the housing removed and the lock arranged in an unlocked state with a key override enabled and the key actuating the key cylinder.
Figure 14:
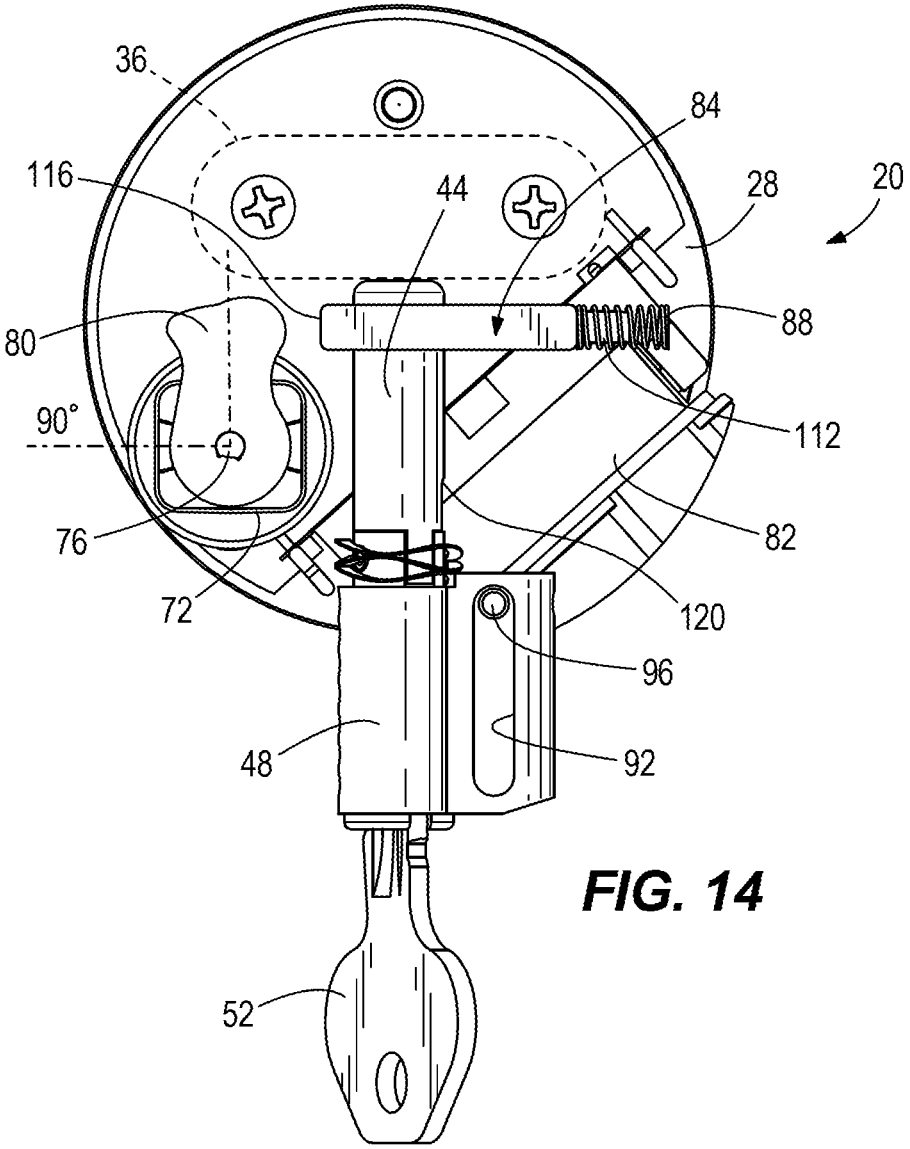
FIG. 14 is a back view of the lock of FIG. 13.

As shown in FIGS. 13 and 14, continued rotation of the key 52 moves the blocker 84 to an open position with the shoulder 108 no longer disposed within the recess 120. In the open position, the cutout 104 of the blocker 84 allows the shackle 44 to pass thereby and move to an open state that does not occlude the locking cavity 36. The pin 96 slides within the slot 92 between the closed state and the open state and limits movement of the key cylinder 48 and the shackle 44. For example, the engagement of the slot 92 and the pin 96 inhibits the key cylinder 48 from being completely removed from the housing 24. With the shackle 44 moved into the open state, the lock 20 can be removed from or installed onto the hasp 56.

Figure 15:
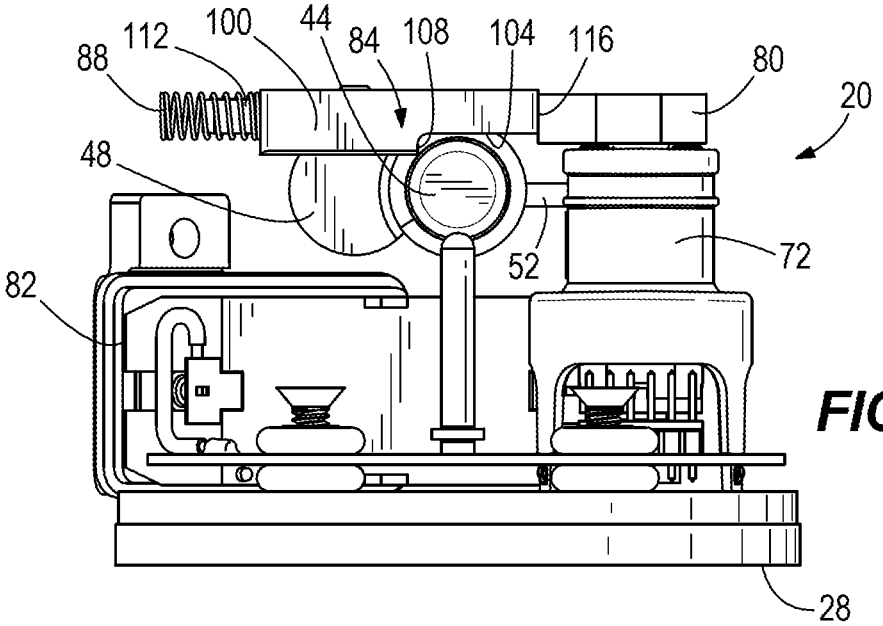
FIG. 15 is a top view of the lock of FIG. 1 with the housing removed and the lock arranged in an electronic unlocked state.
Figure 16:
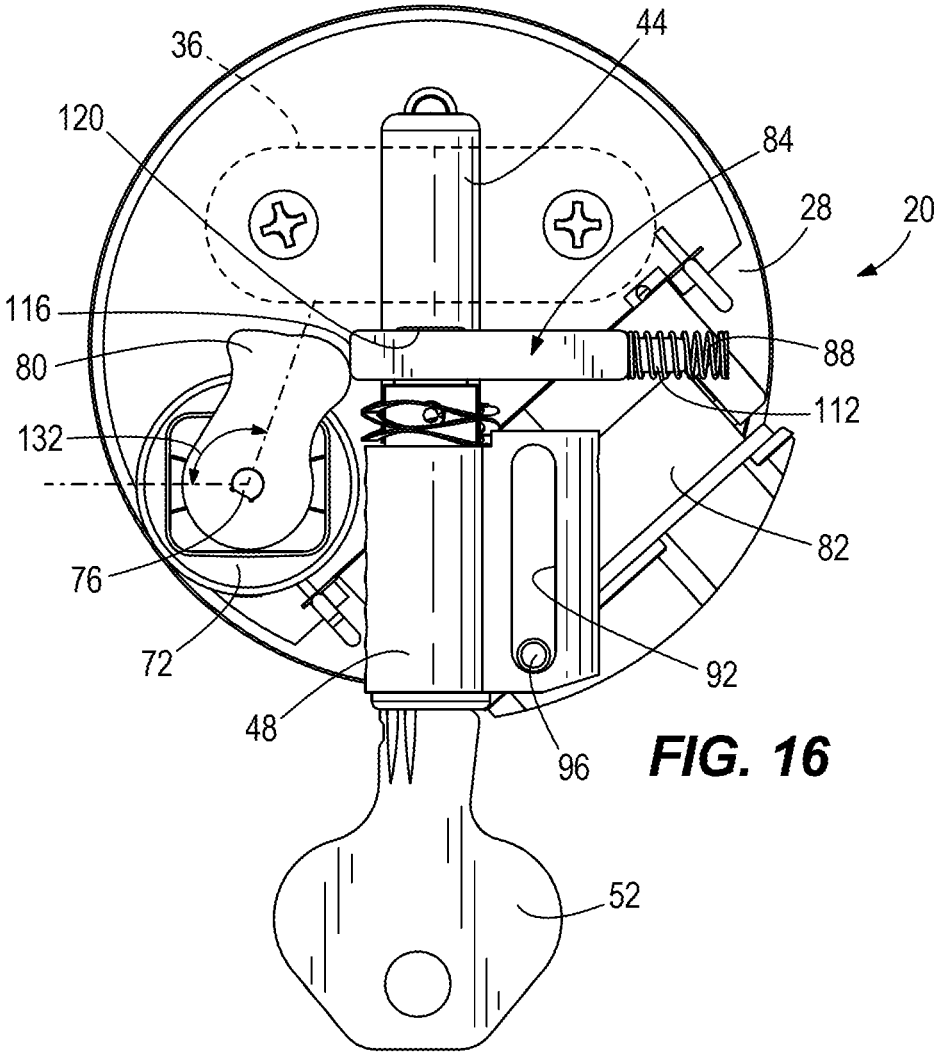
FIG. 16 is a back view of the lock of FIG. 15.

As shown in FIGS. 15 and 16, the third mode the blocker 84 forced into the open position by the cam 80. The motor 72 moves the cam 80 into an electronic unlock position where an unlock angle 132 is about one-hundred-fifteen degrees (115°). In some embodiments, the unlock angle 132 is between about one-hundred degrees (100°) and about one-hundred-thirty degrees (130°). The cam follower 116 of the blocker 84 is biased into engagement with the cam surface of the cam 80 by the spring 88 and the blocker 84 is moved to the open position so that the cutout 104 is positioned adjacent the shackle 44. The cutout 104 does not engage the shackle 44 and the key cylinder 48 and shackle 44 are allowed to move to the open state.

In operation, the user interacts with the keypad 28 to actuate the lock 20 between the first mode, the second mode, and the third mode. In some embodiments, the user enters a passcode into the keypad 28 and presses the lock button. The shackle 44 is then actuated to the electric unlock position. The user can then install the lock 20 onto the hasp 56 and again press the lock button. The shackle 44 is then actuated to the locked state and the cam moved into either the key override enabled or the key override disabled position. If the master key setting is used, then the cam 80 is actuated to the key override disabled position with the blocker 84 in the closed position. If the master key setting is not used, then the cam 80 is actuated to the key override enabled position with the blocker 84 in the intermediate position. Later, the user may again enter the passcode and open the lock 20. If the key override is enabled, any user with a physical key 52 can also open the lock. If the key override is disabled, then only a user with the master key 52 can open the lock 20. In some embodiments, when the master key setting is used, the can 80 is positioned in the key override disabled position until the master key 52 is within range of the keypad 28. Once the master key 52 is in range, then the motor 72 actuates the cam 80 to the key override enabled position, and the master key 52 is allowed to open the lock 20.

The construction and arrangement of the systems, and methods as shown in the various examples are illustrative only. Although only a few constructions have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative constructions. Other substitutions, modifications, changes, and omissions may be made in the design, operating conditions and arrangement of the exemplary constructions without departing from the scope of the disclosure.

The disclosure contemplates methods, systems and program products on any machine-readable media for accomplishing various operations. The exemplary constructions of the disclosure may be implemented using existing computer processors, or by a special purpose computer processor for an appropriate system, incorporated for this or another purpose, or by a hardwired system. Constructions within the scope of the disclosure can include program products comprising machine-readable media (e.g., tangible and/or non-transitory) for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, flash memory, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A lock, comprising:

a housing;

a keypad coupled to the housing and including a user interface;

an actuator in communication with the keypad and movable between a first position, a second position, and a third position;

a cam coupled to the actuator and movable therewith;

a blocker including a cam follower in selective engagement with the cam, a cutout, and a shoulder, the blocker movable between an open position, a closed position, and an intermediate position;

a shackle including a recess sized to receive the blocker and movable between an unlocked state and a locked state; and a key cylinder coupled to and moveable with the shackle, wherein the first position of the actuator includes the cam interacting with the blocker in the closed position, and the blocker engaging the recess of the shackle to maintain the shackle in the locked state, wherein the second position of the actuator includes the cam interacting with the blocker in the intermediate position, the key cylinder rotating the shackle, and the recess of the shackle engaging the shoulder of the blocker and moving the blocker toward the open position, and wherein the third position of the actuator includes the cam interacting with the blocker in the open position, the cutout positioned adjacent the shackle, and the shackle allowed to move between the locked state and the unlocked state.

2. The lock of claim 1, wherein the actuator is a motor and the first position defines a disable angle, the second position defines an enable angle, and the third position defines an electronic open angle.

3. The lock of claim 1, wherein the blocker slides relative to the housing along a first axis between the open position, the intermediate position, and the closed position.

4. The lock of claim 3, wherein the shackle slides relative to the housing in a second axis perpendicular to the first axis.

5. The lock of claim 1, further comprising a physical key engagable with the key cylinder and in communication with the keypad to move the actuator to the second position when the physical key is within a predetermined distance of the lock.

6. The lock of claim 1, wherein the keypad includes a touch screen and wireless connectivity.

7. The lock of claim 1, further comprising a hasp that at least partially surrounds the housing, the shackle selectively engaging the hasp.

8. A lock, comprising:

a shackle movable between an unlocked state and a locked state;

an electronically actuated blocker selectively engaged with the shackle to inhibit movement of the shackle from the locked state to the unlocked state, the blocker movable between a key override disabled position, a key override enabled position, and an electronic unlock position; and a key cylinder structured to move the shackle to the unlocked state when the blocker is in the key override enabled position.

9. The lock of claim 8, further comprising a keypad structured to control the position of the electronically actuated blocker.

10. The lock of claim 9, wherein the keypad is arranged in wireless communication with the key.

11. The lock of claim 8, wherein the electronically actuated blocker includes a body sized to be received within a recess of the shackle.

12. The lock of claim 8, wherein the electronically actuated blocker includes a motor actuated cam movable between a first position corresponding to the key override disabled position, a second position corresponding to the key override enabled position, and a third position corresponding to the electronic unlock position.

13. The lock of claim 8, wherein the electronically actuated blocker is biased toward the key override disabled position by a spring.

14. The lock of claim 8, wherein the electronically actuated blocker slides along a first axis between the key override disabled position, the key override enabled position, and the electronic unlock position, and wherein the shackle slides along a second axis perpendicular to the first axis.

15. A method, comprising:

moving a cam to a key override disabled position with an electronic actuator;

biasing a blocker into engagement with the cam so that the blocker is in a closed position when the cam is in the key override disabled position;

inhibiting movement of a shackle from a locked position to an unlocked position when the blocker is in the closed position;

moving the cam to a key override enabled position with the electronic actuator;

biasing the blocker into engagement with the cam so that the blocker is in an intermediate position when the cam is in the key override enabled position;

inhibiting movement of the shackle from the locked position to the unlocked position when the blocker is in the intermediate position; and rotating the shackle with a key cylinder so the blocker is moved to an open position by the movement of the shackle when the cam is in the key override enabled position thereby allowing the shackle to move to the unlocked position.

16. The method of claim 15, further comprising:

moving the cam to an electronic unlock position with the electronic actuator;

biasing the blocker into engagement with the cam so that the blocker is in the open position when the cam is in the electronic unlock position;

allowing movement of the shackle from the locked position to the unlocked position when the blocker is in the open position.

17. The method of claim 15, wherein moving the cam includes rotating the cam with a motor.

18. The method of claim 15, wherein biasing the blocker includes moving the blocker with the cam against a bias provided by a spring.

19. The method of claim 15, wherein biasing the blocker includes moving the blocker linearly in response to movement of the cam.

20. The method of claim 15, wherein movement of the shackle is perpendicular to movement of the blocker.

* * * * *